United States Patent [19]

Smith

[11] 4,446,007

[45] May 1, 1984

[54] HYDRODEWAXING

[75] Inventor: Fritz A. Smith, Rye, N.Y.

[73] Assignee: Mobil Oil Corporation, New York, N.Y.

[21] Appl. No.: 386,463

[22] Filed: Jun. 8, 1982

[51] Int. Cl.[3] ..... C10G 47/16

[52] U.S. Cl. ..... 208/111; 208/154

[58] Field of Search ..... 208/111, 27, 154; 252/455 Z, 411 R

[56] References Cited

U.S. PATENT DOCUMENTS

| | | | |
|---|---|---|---|
| 3,654,138 | 4/1972 | Mosby et al. | 208/111 |
| 3,998,722 | 12/1976 | Mayer et al. | 208/154 |
| 4,048,094 | 9/1977 | Menzl et al. | 208/27 |

*Primary Examiner*—Delbert E. Gantz
*Assistant Examiner*—Anthony McFarlane
*Attorney, Agent, or Firm*—Alexander J. McKillop; M. G. Gilman; L. G. Wise

[57] ABSTRACT

An improved method for hydrodewaxing a petroleum or shale oil fraction, e.g. petroleum distillate, in a reactor is provided which involves contacting said fraction with hydrogen in the presence of a catalyst comprising a crystalline zeolite having a silica to alumina mole ratio of at least 12 under hydrodewaxing conditions wherein the average reactor temperature at start-up of from about 200° C. to 310° C. is increased uniformly to at least 360° C. within about seven days from start-up.

18 Claims, 7 Drawing Figures

TEMPERATURE CHANGE THROUGH HYDRODEWAXING REACTOR

HYDRODEWAXING

BACKGROUND OF THE INVENTION

1. Field of the Invention

This invention relates to an improved method for the operation of a hydrodewaxing unit wherein a petroleum or shale oil fraction is contacted with a catalyst comprising a crystalline zeolite having a high silica/alumina mole ratio of at least 12 and a constraint index of from about 1 to about 12 under hydroprocessing conditions including a hydrogen atmosphere and elevated temperature and pressure. The improvement of the present method resides in increasing the average reactor temperature in a uniform manner to at least about 360° C. within about the first seven days from start-up, said start-up being at an average reactor temperature of from about 200° C. to about 310° C.

2. Description of the Prior Art

Hydrocarbon conversion processes utilizing crystalline zeolite catalysts have been the subject of extensive investigation during recent years as is clear from both the patent and scientific literature. Crystalline aluminosilicates have been found to be particularly effective for a wide variety of hydrocarbon conversion processes and have been described and claimed in many patents including U.S. Pat. Nos. 3,140,249; 3,140,252; 3,140,251; 3,140,253; and 3,271,418. Aside from serving as general catalysts in hydrocarbon conversion processes, it is also known that the molecular sieve properties of zeolites can be utilized to preferentially convert one molecular species from a mixture of the same with other species.

In a process of this type a zeolite molecular sieve is employed having catalytic activity within its internal pore structure and pore openings such that one component of a feed is capable of entering within the internal pore structure thereof and being converted to the substantial exclusion of another component which, because of its size, is incapable of entering within the pores of the zeolitic material. Shape selective catalytic conversion is also known in the art and is disclosed and claimed in U.S. Pat. Nos. 3,140,322; 3,379,640 and 3,395,094.

Although a wide variety of zeolitic materials and particularly crystalline aluminosilicates have been successfully employed in various catalytic conversion processes, nevertheless, these prior art processes, in general, fell into one or two main categories. In one type of conversion process a zeolite was employed which had a pore size sufficiently large to admit the vast majority of components normally found in a charge, i.e., these materials are referred to as large pore size molecular sieves and they are generally stated to have a pore size of from 6 to 13 angstroms and are represented by zeolites X, Y and L. The other type of aluminosilicate was one which had a pore size of approximately 5 angstrom units and it was utilized to preferentially act upon normal paraffins to the substantial exclusion of other molecular species. Thus, by way of considerable over-simplification until recently, there were only two types of aluminosilicates which were available for hydrocarbon processing—those which would admit only normal paraffins and those which would admit all components normally present in a hydrocarbon feed charge. See U.S. Pat. No. 3,700,585 and Canadian Pat. No. 829,282.

The cracking and/or hydrocracking of petroleum stocks is in general well known and widely practiced. It is known to use various zeolites to catalyze cracking and/or hydrocracking processes.

Of particular recent interest has been the use of a novel class of catalysts to assist in the dewaxing of gas oils, lube base stocks, kerosines and whole crudes, including syn crudes obtained from shale, tar sands and coal hydrogenation. U.S. Pat. No. 3,700,585 discloses the use of ZSM-5 type zeolites to efficiently catalyze dewaxing of various petroleum feedstocks.

U.S. Pat. No. 3,700,585 discloses and claims the cracking and hydrocracking of paraffinic materials from various hydrocarbon feedstocks by contacting such feedstock with a ZSM-5 zeolite at about 290° to 712° C., 0.5 to 200 LHSV and with a hydrogen atmosphere in some cases. This patent is based upon work on the dewaxing of gas oils, particularly virgin gas oils, and crudes although its disclosure and claims are applicable to the dewaxing of any mixture of straight chain, slightly branched chain and other configuration hydrocarbons. The catalyst may have a hydrogenation/dehydrogenation component incorporated therein.

Other U.S. patents teaching dewaxing of various petroleum stocks are U.S. Pat. No. Re. 28,398; U.S. Pat. Nos. 3,852,189; 3,891,540; 3,894,933; 3,894,938; 3,894,939; 3,926,782; 3,956,102; 3,968,024; 3,980,550; 4,067,797 and 4,192,734.

Catalytic hydrodewaxing can be considered to be a relatively mild, shape selective cracking or hydrocracking process. It is shape selective because of the inherent constraints of the catalyst pore size upon the molecular configurations which are converted. It is mild because the conversions of gas oil feed to lower boiling range products are small, e.g. usually below about 35 percent and more usually below about 25 percent. It is operative over a wide temperature range but is usually carried out at relatively low temperatures, e.g. start of run temperatures of about 270° C. are usual.

SUMMARY OF THE INVENTION

The known process to which this invention is directed is a process of upgrading and improving the quality of petroleum or shale oil fractions, including distillate, by contacting same under hydrodewaxing conditions including an average reactor temperature of about 200° to 712° C., space velocity of about 0.2 to 10 LHSV, hydrogen to hydrocarbon mole ratios of about greater than 0, e.g. 0.1, to 20, and a pressure of about 100 to 3000 psig with a catalyst comprising a crystalline zeolite having a high silica to alumina mole ratio of at least about 12, a constraint index of about 1 to 12 and, preferably, a crystal density of not substantially below about 1.6 grams per cubic centimeter. These operating parameters constitute the state of the art as exemplified by U.S. Pat. No. 3,700,585.

During this process, it is usual to find that hydrogen consumption is highest during a first period, e.g. about thirty days, on stream and that, during this first period, there is an unusually large difference between product pour point and cloud point and the octane of the by-product gasoline produced is low, e.g. less than about 82 research clear. These factors are problems which are avoided by the improvement of the present invention. That improvement resides in the discovery that rapidly, i.e. within about the first seven days from reactor start-up, increasing the average reaction temperature in a uniform manner to at least 360+ C., preferably from at least 360° C. to about 380° C., hydrogen consumption is reduced to normal acceptable limits and the product pour point and cloud point difference is minimized. The result is a dewaxed product which meets or exceeds pour point requirements and a gasoline boiling range by-product having a research clear octane number of greater than about 82.

DESCRIPTION OF SPECIFIC EMBODIMENTS

Figure 1:
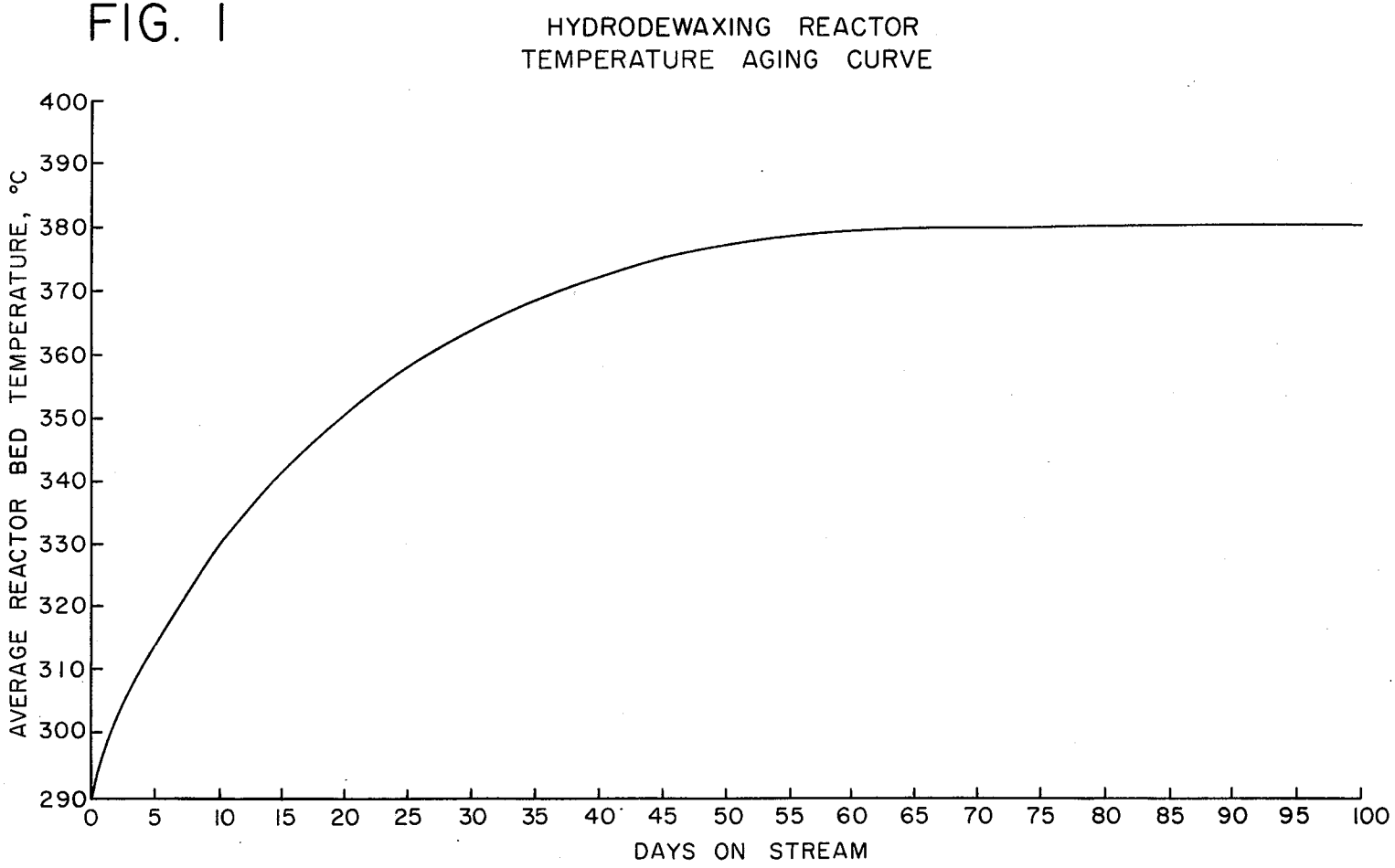
FIG. 1 is a temperature aging curve depicting usual prior art catalyst performance in a typical hydrodewaxing unit for a petroleum distillate feedstock having a boiling range of from about 165° C. to about 400° C.
Figure 2:
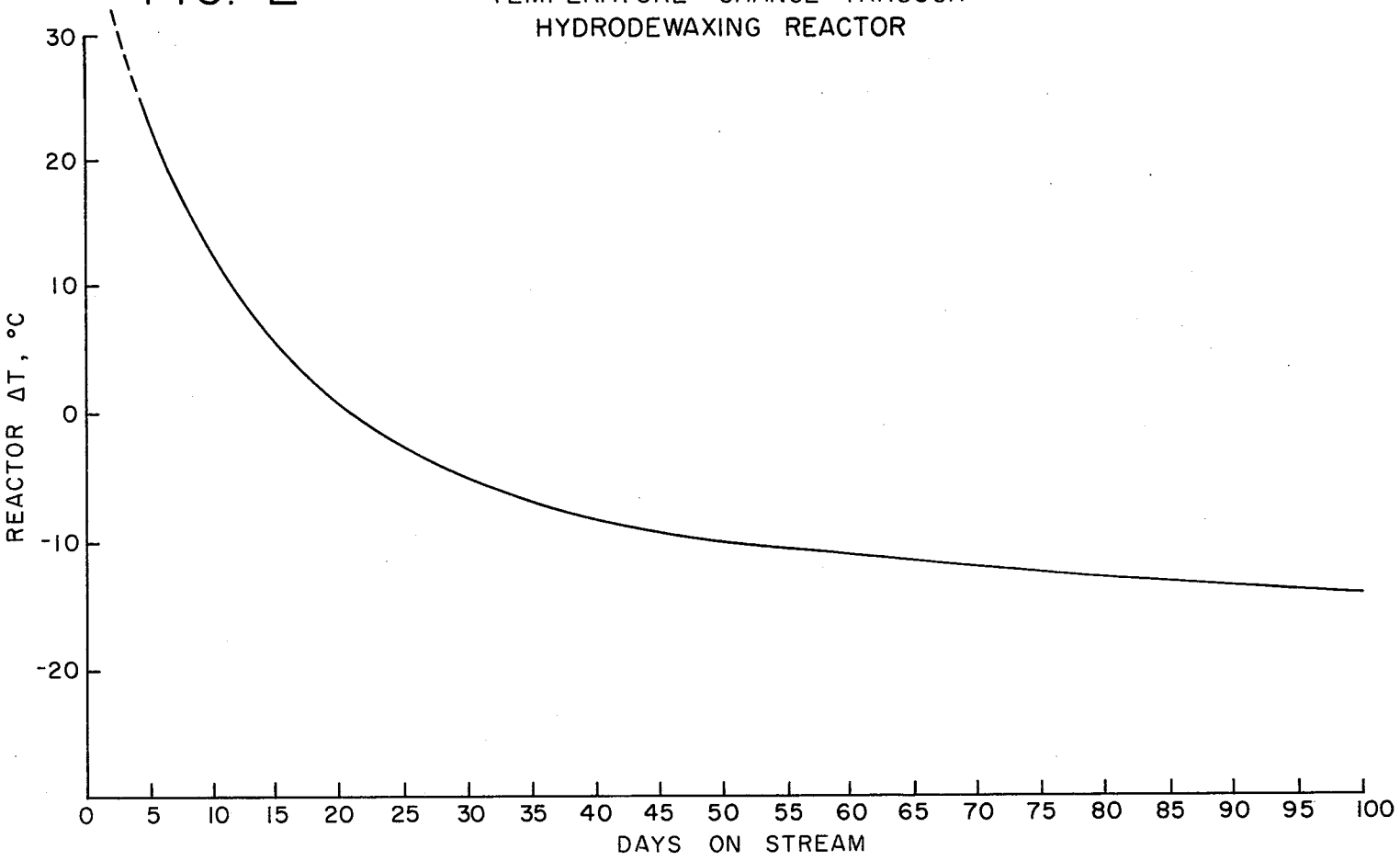
FIG. 2 in a plot of temperature change across a typical prior art hydrodewaxing unit reactor during the first 100 days on stream. The expression "ΔT" refers to the difference between inlet and outlet temperature of the reactor.

In the dewaxing process to which the present improvement attaches, normal start-up temperature is between 200° C. and 310° C. and most usually about 290° C. This is because temperatures in the range of 200° C. to 310° C. will allow oil to be introduced to the catalyst without causing excessive exothermic reaction. Therefore, a low start-up temperature avoids the possibility of excessive coke make on the catalyst.

During the first period, i.e. within about thirty days from start-up, hydrogen consumption for paraffinic stocks is in the range of about +20 $Nm^3/Kl$ to about −10 $Nm^3/Kl$. During that time, product pour point of the distilled distillate will range from about 20° C. to about 60° C. less than the pour point of the charge stock and cloud point will range from about 20° C. to about 60° C. less than the cloud point of the charge stock. When the improvement of this invention is practiced in the process, hydrogen consumption quickly lines out at from about +15 $Nm^3/Kl$ to about −15 $Nm^3/Kl$, and product pour point and cloud point values will generally be less than 0° C. and 10° C., respectively. The savings in hydrogen is significant and product quality is noticable. For naphthenic stocks, analogous results are observed. For both paraffinic and naphthenic stocks, the research clear octane number of the process by-product gasoline will usually be low, i.e. less than 82, during the first period of operation without the present improvement being practiced.

The increasing of reactor temperature by the present invention is to be conducted in a uniform manner. The term "uniform manner" is intended to mean continuous, steady or systematic where during the initial seven days from reactor start-up, the average reactor temperature is increased from the start-up temperature to at least 360° C. The increase may be step-wise continuous or steady. The rate of increase will, of course, depend upon the start-up temperature. For example, if start-up is at 290° C., a daily increase of 10° C., an eight hour period increase of 3.3° C., or an hourly increase of 0.42° C. would be acceptable.

The catalyst for use in the present process continues to comprise a member of a novel class of crystalline zeolites which exhibit some unusual properties. These zeolites induce profound transformations of aliphatic hydrocarbons to aromatic hydrocarbons in commercially desirable yields and are generally highly effective in conversion reactions involving aromatic hydrocarbons. Although they have unusually low alumina contents, i.e. high silica to alumina mole ratios, they are very active even when the silica to alumina ratio exceeds 30. This activity is surprising since catalytic activity is generally attributed to framework aluminum atoms and cations associated with these aluminum atoms. These zeolites retain their crystallinity for long periods in spite of the presence of steam at high temperature which induces irreversible collapse of the framework of other zeolites, e.g. of the X and A type. Furthermore, carbonaceous deposits, when formed, may be removed by burning at elevated temperatures to restore activity. In many environments the zeolites of this class exhibit very low coke forming capability conducive to very long times on stream between burning regenerations. In still other environments these same zeolites exhibit very high coke forming tendencies, but give long on-stream times despite high coke loading.

An important characteristic of the crystal structure of this class of zeolites is that it provides constrained access to, and egress from, the intra-crystalline free space by virtue of having a pore dimension greater than about 5 Angstroms and pore windows of about a size such as would be provided by 10-membered rings of oxygen atoms. It is to be understood, of course, that these rings are those formed by the regular disposition of the tetrahedra making up the anionic framework of the crystalline aluminosilicate, the oxygen atoms themselves being bonded to the silicon or aluminum atoms at the centers of the tetrahedra. Briefly, the preferred zeolites useful in this invention possess, in combination: a silica to alumina mole ratio of at least about 12; and a structure providing constrained access to the crystalline free space.

Rather than attempt to judge from crystal structure whether or not a zeolite possesses the necessary constrained access, a simple determination of the "constraint index" may be made. The "constraint index" is a measure of the selectivity of the particular catalyst and it involves conversion of normal hexane and 3-methylpentane. This test is described in many U.S. patents, including U.S. Pat. Nos. 4,231,899 and 4,288,647, and in the Journal of Catalysis, Volume 67, pp. 218–222 (1981), said descriptions being incorporated herein by reference. Catalysts suitable for the present process are those comprising a zeolite having a constraint index of from about 1 to about 12.

Of the zeolite materials useful in the present process, zeolites ZSM-5, ZSM-11, ZSM-12, ZSM-23, ZSM-35, ZSM-38 and ZSM-48 are noted. Zeolite ZSM-5 is preferred. ZSM-5 is described in U.S. Pat. No. 3,702,886 and U.S. Pat. No. Re. 29,948, the entire contents of each being hereby incorporated by reference herein. ZSM-11 is described in U.S. Pat. No. 3,709,979, the teaching of which is incorporated herein by reference. ZSM-12 is described in U.S. Pat. No. 3,832,449, the contents of which are incorporated herein by reference. ZSM-23 is described in U.S. Pat. No. 4,076,842, the teaching of which is incorporated herein by reference. The contents of U.S. Pat. Nos. 4,016,245 and 4,046,859, describing ZSM-35 and ZSM-38, respectively, are incorporated herein by reference.

ZSM-48 can be identified, in terms of moles of anhydrous oxides per 100 moles of silica as follows:

$$(0.05 \text{ to } 5)N_2O:(0.1 \text{ to } 10)M_{2/n}O:(0 \text{ to } 4)Al_2O_3:(100)SiO_2$$

wherein M is at least one cation having a valence n, N is a mixture of a $C_2$–$C_{12}$, and more preferably of a $C_3$–$C_5$, alkylamine and a tetramethylammonium compound and wherein the composition is characterized by the distinctive X-ray diffraction pattern as shown below:

| Characteristics Lines of Zeolite ZSM-48 | |
|---|---|
| d (A) | Relative Intensity (I/Io) |
| 11.8 ± 0.2 | S |
| 10.2 ± 0.2 | W-M |
| 7.2 ± 0.15 | W |
| 4.2 ± 0.08 | VS |
| 3.9 ± 0.08 | VS |
| 3.6 ± 0.06 | W |
| 3.1 ± 0.05 | W |
| 2.85 ± 0.05 | W |

These values were determined by standard techniques. The radiation was the K-alpha doublet of copper, and a diffractometer equipped with a scintillation counter and a strip chart pen recorder was used. The peak heights, I, and the positions as a function of two time theta, where theta is the Bragg angle, were read from the spectrometer chart. From these, the relative intensities, 100 $I/I_o$, where $I_o$ is the intensity of the strongest line or peak, and d (obs.), the interplanar spacing in Angstroms (A) corresponding to the recorded lines, were calculated. In the foregoing table the relative intensities are given in terms of the symbols W=weak, VS=very strong, M=medium and W-M=weak-to-medium (depending on the cationic form). Ion exchange of the sodium ion with cations reveals substantially the same pattern with some minor shifts in interplanar spacing and variation in relative intensity. Other minor variations can occur depending on the silicon to aluminum ratio of the particular sample, as well as if it has been subjected to thermal treatment.

ZSM-48 can be prepared from a reaction mixture containing a source of silica, tetramethylammonium compound, $C_2$–$C_{12}$ alkylamine, an alkali metal oxide, e.g. sodium, with or without a source of alumina, and water, and having a composition, in terms of mole ratios of oxides, falling within the following ranges:

| REACTANTS | BROAD | PREFERRED |
|---|---|---|
| $Al_2O_3/SiO_2$ | 0 to 0.08 | 0 to 0.02 |
| $Na_2O/SiO_2$ | 0.01 to 1.0 | 0.1 to 0.5 |
| $N_2O/SiO_2$ | 0.005 to 0.5 | 0.005 to 0.25 |
| $OH^-/SiO_2$ | 0.01 to 0.5 | 0.05 to 0.2 |
| $H_2O/SiO_2$ | 10 to 200 | 20 to 100 |

wherein N is a mixture of a $C_2$–$C_{12}$ alkylamine and tetramethylammonium compound, and maintaining the mixture at 80°–200° C. until crystals of ZSM-48 are formed.

The molar ratio of $C_2$–$C_{12}$ alkylamine to tetramethyl ammonium compound is not narrowly critical and can range from 1:1 to 10:1. The tetramethylammonium compound can include the hydroxide or halide with the chloride being particularly preferred.

The zeolites used as catalysts in this process may be in the hydrogen form or they may be base exchanged or impregnated to contain ammonium or a metal cation complement. It is desirable to calcine the zeolite after base exchange. The metal cations that may be present include any of the cations of the metals of Groups I through VIII of the Periodic Table. However, in the case of Group IA metals, the cation content should in no case be so large as to effectively inactivate the catalyst. For example, a completely sodium exchanged H-ZSM-5 is largely inactive in the present process.

In a preferred aspect of this process, the zeolites useful as catalysts are selected as those having a crystal framework density, in the dry hydrogen form, of not substantially below about 1.6 grams per cubic centimeter. It has been found that zeolites which satisfy all three of these criteria, i.e. silica to alumina mole ratio, constraint index and crystal framework density, are most desired. Therefore, the preferred zeolites are those having a constraint index as defined above of about 1 to 12, a silica to alumina ratio of at least about 12 and a dried crystal density of not substantially less than about 1.6 grams per cubic centimeter. The dry density for known structures may be calculated from the number of silicon plus aluminum atoms per 1000 cubic Angstroms, as given, e.g., on page 19 of the article on Zeolite Structure by W. M. Meier. This paper, the entire contents of which are incorporated herein by reference, is included in "Proceedings of the Conference on Molecular Sieves, London, April 1967", published by Society of Chemical Industry, London, 1968. When the crystal structure is unknown, the crystal framework density may be determined by classical pyknometer techniques. For example, it may be determined by immersing the dry hydrogen form of the zeolite in an organic solvent which is not sorbed by the crystal. It is possible that the unusual sustained activity and stability of this class of zeolites is associated with its high crystal anionic framework density of not less than about 1.6 grams per cubic centimeter. This high density, of course, must be associated with a relatively small amount of free space within the crystal, which might be expected to result in more stable structures. This free space, however, seems to be important as the locus of catalytic activity.

Non-limiting examples of the feed to the instant improved process include 200° C. to 510° C. virgin, hydrotreated or cracked atmospheric gas oils or 205° C. to 535° C. virgin, hydrotreated or cracked vacuum gas oils, or combination mixtures thereof. The feed may also constitute a shale oil fraction boiling between about 200° C. and 538° C.

Referring now more particularly to the drawings, where the data of FIGS. 1 through 4 are for a gas oil feed stock derived from paraffinic type Persian Gulf crude oils, FIG. 1 depicts overall performance of an above-defined catalyst in a typical commercial adiabatic hydrodewaxing unit by way of a temperature aging curve. The catalyst aging curve can be considered in two distinct parts for the present analysis. The first part, or period, is made up of, in this instance, about the first 30 to 40 days on stream. We may refer to this first period as the catalyst break-in period. The second part, or period, is the equilibrium period which runs subsequent to the break-in period.

In this typical hydrodewaxing process, the catalyst ages rapidly during the first period. During this first period, as can be observed from FIG. 2, the reactor ΔT, i.e. the difference between reactor inlet and reactor outlet temperature, is larger than during the equilibrium period. The ΔT drops from greater than 20° C. to 0° C. during, in this instance, about the first 20 days on stream and then approaches about −8° C. at about 40 days. ΔT is at −14° C. at about 100 days on stream.

Figure 3:
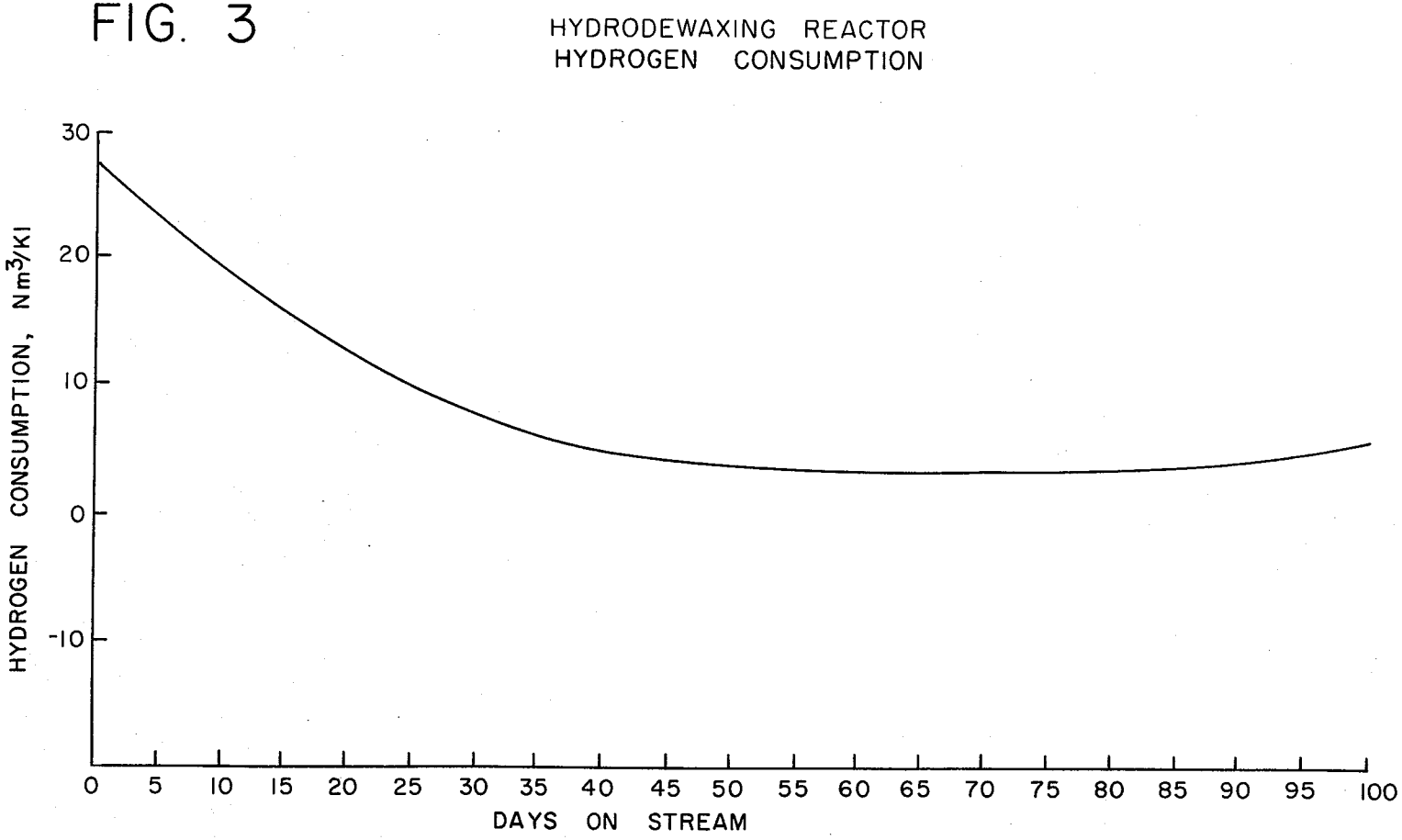
FIG. 3 is a plot of hydrogen consumption in a typical prior art hydrodewaxing unit during the first 100 days on stream.

FIG. 3 shows hydrogen consumption during the first 100 days on stream. During the first period, i.e. from start-up to about 40 days, hydrogen-consumption is highest starting at about 28 $Nm^3/Kl$ and dropping to about 5 $Nm^3/Kl$ at the 40 day mark.

It is observed from these plots that during the first period the hydrodewaxing reaction is exothermic causing the temperature across the reactor to increase. This, in turn, creates increased hydrogen consumption. The reaction becomes slightly endothermic near the end of the first period and hydrogen consumption decreases.

By the present method, the first period, i.e. break-in period, will be compressed into about 5 to 7 days by creating a higher average reactor temperature during a shorter period of time. The result will be a dewaxed product which exceeds the pour point requirement without any negative product or process results. It will provide the distinct advantage of reducing the total hydrogen consumption during the consequently shortened break-in period.

Not wishing to be bound by any theory of operation, it appears that the exothermic to endothermic reaction pattern of the catalyst for use herein may be related to the aging of the catalyst's weak hydrogenation function and to thermodynamic equilibrium where higher temperatures are less favorable for saturation.

Figure 4:
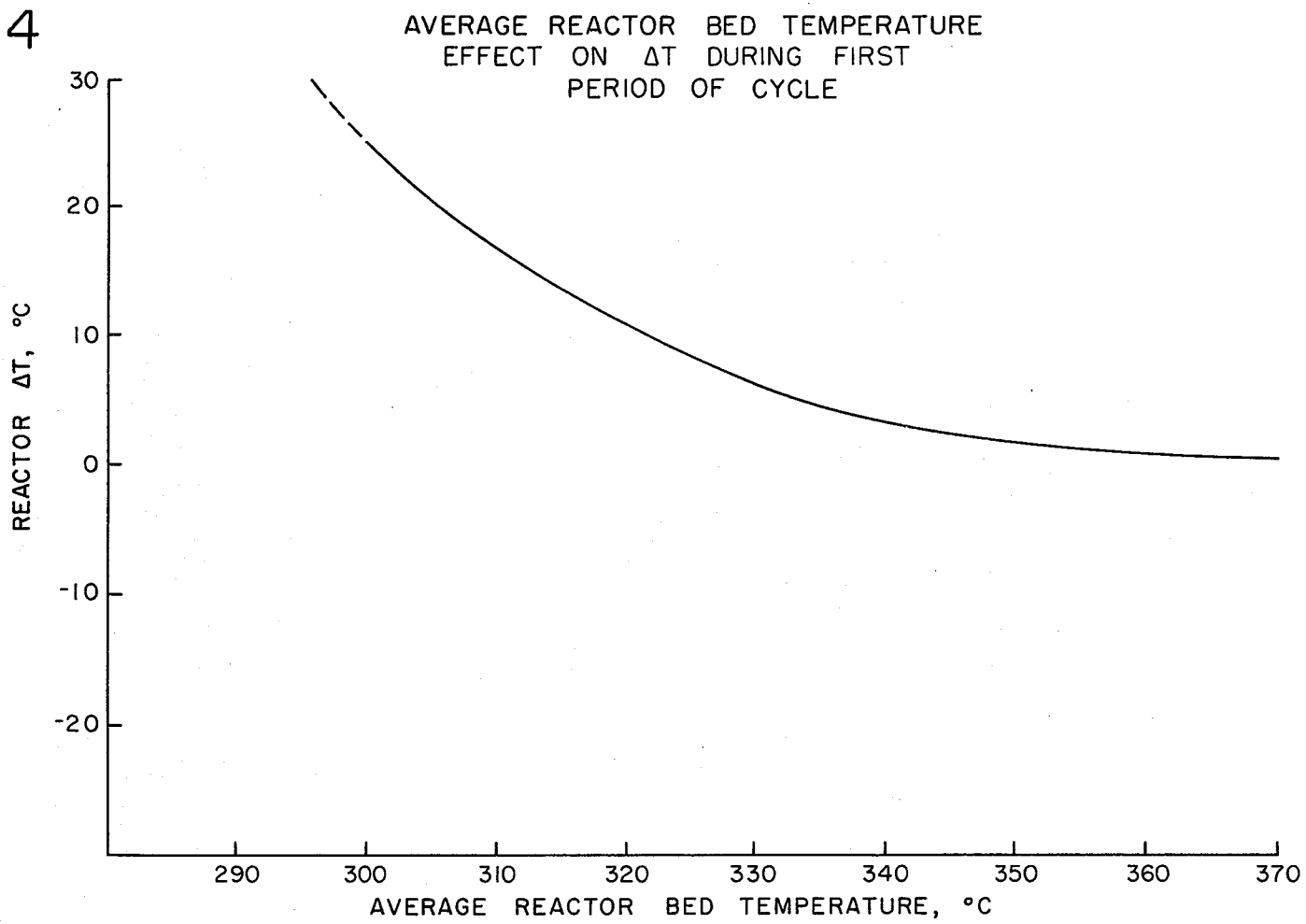
FIG. 4 is a plot of a typical prior art hydrodewaxing unit reactor ΔT relative to the average reactor bed temperature.

For instance, FIG. 4 shows that as the average reactor temperature of the catalyst bed is increased during the first period, the inlet minus outlet (ΔT) temperature becomes smaller. Therefore, hydrogenation reactions become small once a temperature of about 360° C. is attained. Consequently, hydrogen consumption during the first period will be minimized by the present method by raising the reactor temperature as quickly as possible, in a scheduled manner, over about a one week period from start-up.

The following examples illustrate the practice of the present improved method.

EXAMPLE 1

A heavy gas oil feedstock having the properties shown in Table 1 is charged to a reactor containing catalyst comprising a zeolite having a silica to alumina mole ratio of at least 12, i.e. about 70, and a constraint index of 1 to 12, i.e. 8.3, and the X-ray diffraction pattern characteristics of zeolite ZSM-5. The start-up temperature, liquid hourly space velocity, reactor inlet pressure and hydrogen circulation rate are 260° C., 1.0, 520 psig and 350 $Nm^3/Kl$, respectively. The reactor inlet temperature is maintained at 260° C. for about 2 hours to permit the fresh catalyst to become thoroughly contacted with feedstock reactant at a temperature low enough to prevent excessive coking. Then, the inlet temperature of the reactor is uniformly increased to 365° C. over the next 160 hours at a rate of about 5° C. to 6° C. every 8 hours. The reactor ΔT is less than zero and the hydrogen consumption less than about 10 $Nm^3/Kl$ at the end of 168 hours on stream. The pour point of the distillate product is less than 0° C. at this point.

TABLE 1

| Charge Stock for Example 1 | |
|---|---|
| Crude Source | Persian Gulf |
| Specific Gravity | 0.8771 to 0.8882 |
| Pour Point, °C. | +14 to +20 |
| ASTM D-1160 95% Point, °C. | 424 to 452 |

EXAMPLE 2

In this example an isothermal reactor was used twice to process a naphthenic type gas oil feed stock identified in Table 2 over two separate, different catalysts. One catalyst comprised a hydrogen form zeolite having a silica to alumina mole ratio of greater than 12, i.e. about 70, a constraint index of from 1 to 12, i.e. estimated 8.3, and X-ray diffraction characteristics of zeolite HZSM-5. This catalyst had a surface area of 350 $m^2/g$. The other catalyst comprised a zeolite ZSM-5 exchanged with nickel, i.e. NiZSM-5, and it had a surface area of 330 $m^2/g$, a pore volume of 0.726 cc/g and an average pore diameter of 88 square Angstroms. Operating conditions for both reactor runs were maintained at 1.0 LHSV and 400 psig with hydrogen circulation rate varied. The reactor temperature was increased as the runs proceeded as indicated in Table 3 which also shows the hydrogen circulation rates.

TABLE 2

| Charge Stock For Example 2 | |
|---|---|
| Type | Nigerian Light Gas Oil |
| API Gravity, °API | 25.6 |
| Hydrogen, wt. % | 12.92 |
| Sulfur, wt. % | 0.21 |
| Nitrogen, wt. % | 0.07 |
| Basic Nitrogen, ppmw | 400 |
| Pour Point, °C. | 35 |
| Aniline Point, °C. | 82.7 |
| Cloud Point, °C. | 34.4 |
| ASTM D-1160, °C. | |
| 10% | 367 |
| 50% | 396 |
| 90% | 432 |

TABLE 3

| | Catalyst Comprising | | | | | |
|---|---|---|---|---|---|---|
| | HZSM-5 | | | NiZSM-5 | | |
| Days On Stream | 3.3 | 9.3 | 22.5 | 3.0 | 6.8 | 11.8 |
| Temperature, °C. | 331 | 380 | 402 | 332 | 373 | 392 |
| Hydrogen Circulation, SCF/B | 2499 | 2920 | 2798 | 4145 | 4025 | 4220 |

Figure 5:
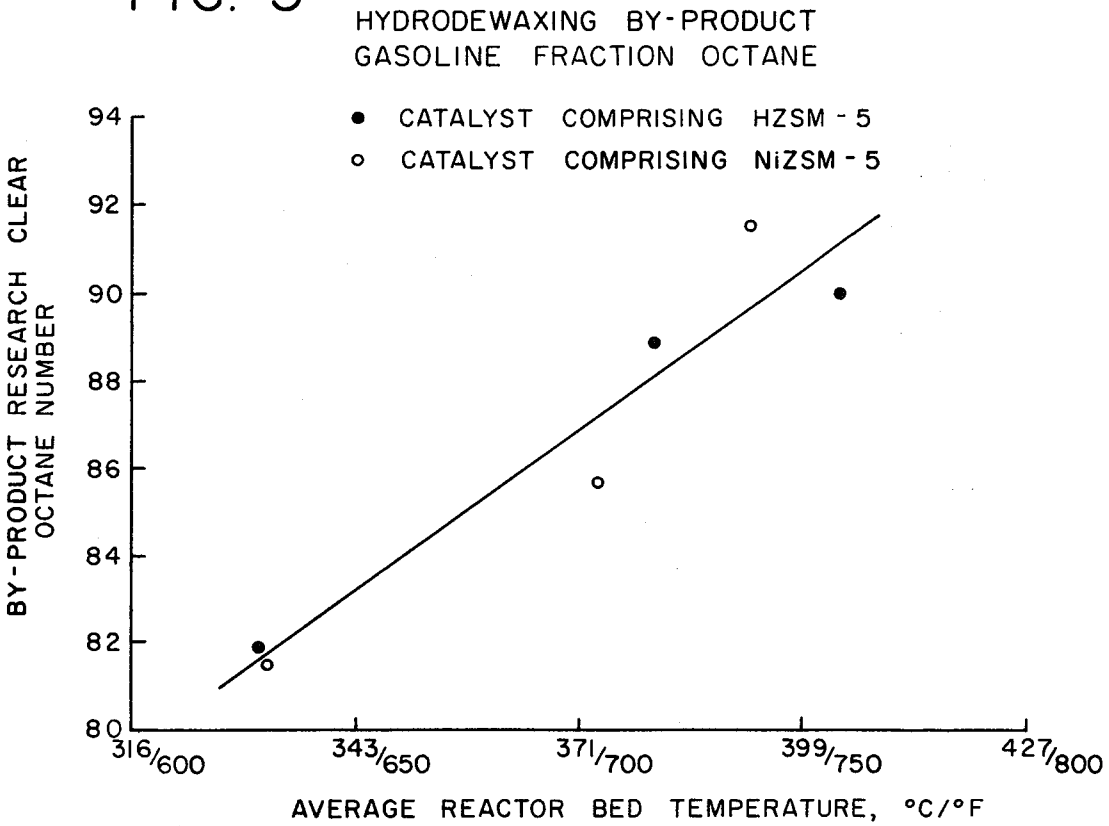
FIG. 5 is a plot of average reactor bed temperature in a typical hydrodewaxing unit versus the research clear octane number of the by-product gasoline fraction according to the present invention.
Figure 6:
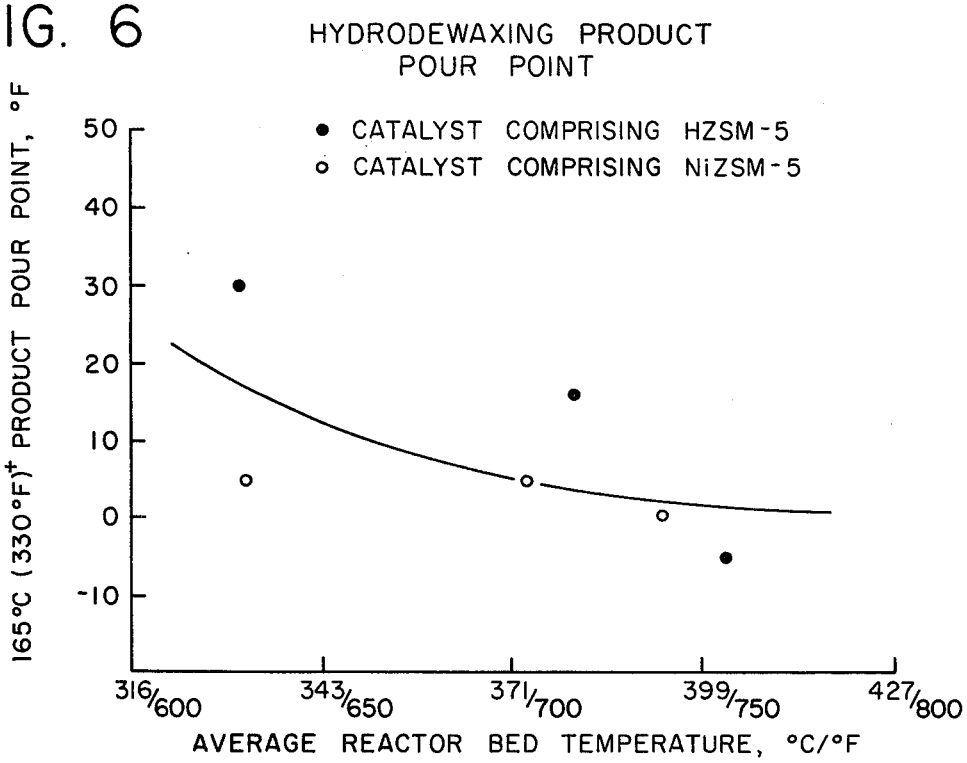
FIG. 6 is a plot of the pour point of a 165° C. (330° F.)+ distillate product as a function of average reactor bed temperature in a typical hydrodewaxing unit.
Figure 7:
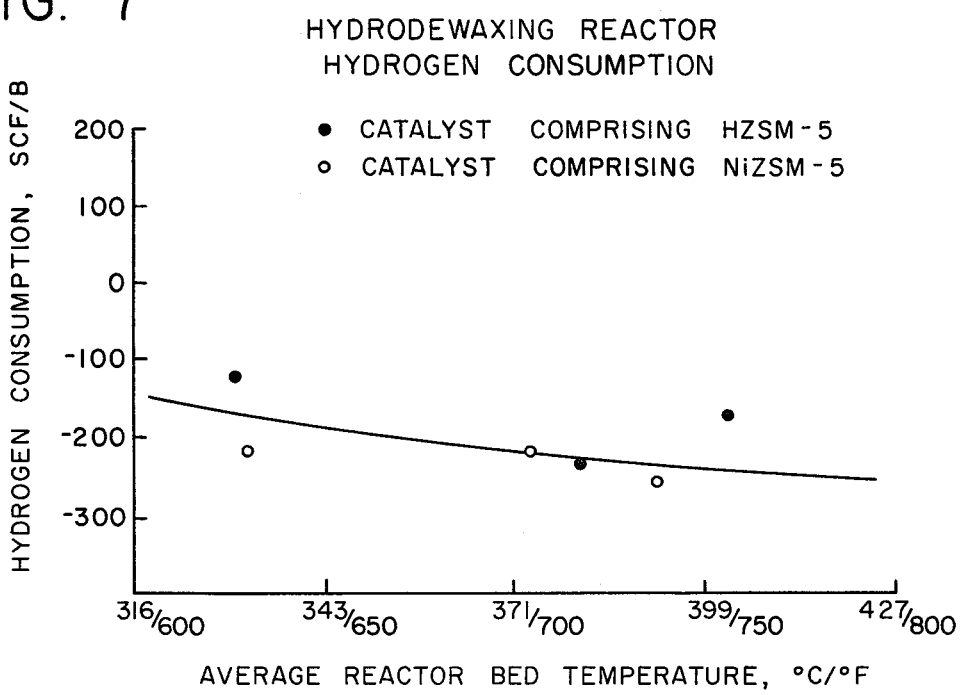
FIG. 7 is a plot of hydrogen consumption as a function of the average reactor bed temperature in a typical hydrodewaxing unit.

The data generated by this Example 2 is presented in FIGS. 5, 6 and 7. From FIG. 5, it is clear that raising the reactor temperature increases the octane number of the by-product gasoline fraction. The clear octane of the gasoline fraction by-product will exceed 82 when the average reactor temperature is 360° C. or higher. Similarly, FIG. 6 shows that raising the reactor temperature by way of the present invention, i.e. early in the first period of operation, provides a beneficial effect by lowering the product pour point to acceptable levels. Likewise, FIG. 7 illustrates that hydrogen production is increased (hydrogen consumption is decreased) as the temperature is raised.

What is claimed is:

1. In the method for catalytically hydrodewaxing a petroleum or shale oil fraction in a reactor by contacting said fraction with hydrogen in the presence of a catalyst comprising a crystalline zeolite having a silica to alumina mole ratio of at least 12 at an average reactor temperature of from about 200° C. to about 712° C., a liquid hourly space velocity of from about 0.2 to about 10, a reactor pressure of from about 100 psig to about 3000 psig and a hydrogen to hydrocarbon mole ratio of from about greater than 0 to about 20, and wherein said reactor is started up at an average reactor temperature of from about 200° C. to about 310° C., the improvement which comprises increasing the average reactor temperature in a uniform manner to at least about 360° C. within about the first seven days after start-up of the reactor.

2. The method of claim 1 wherein said crystalline zeolite is selected from the group consisting of ZSM-5, ZSM-11, ZSM-12, ZSM-23, ZSM-35, ZSM-38 and ZSM-48.

3. The method of claim 2 wherein said crsytalline zeolite is ZSM-5.

4. The method of claim 1 wherein said fraction is a petroleum distillate.

5. The method of claim 2 wherein said fraction is a petroleum distillate.

6. The method of claim 3 wherein said fraction is a petroleum distillate.

7. The method of claim 4, 5 or 6 wherein said petroleum distillate is a 200° C. to 510° C. virgin, hydrotreated or cracked atmospheric gas oil or a 205° C. to 535° C. virgin, hydrotreated or cracked vacuum gas oil or a combination thereof.

8. The method of claim 1 wherein said fraction is a shale oil fraction boiling between about 200° C. and about 538° C.

9. The method of claim 2 wherein said fraction is a shale oil fraction boiling between about 200° C. and about 538° C.

10. The method of claim 3 wherein said fraction is a shale oil fraction boiling between about 200° C. and about 538° C.

11. The method of claim 1, 2 or 3 wherein said fraction is a paraffinic atmospheric gas oil, a paraffinic vacuum gas oil, a naphthenic atmospheric gas oil, a naphthenic vacuum gas oil or a combination mixture thereof.

12. The method of claim 11 wherein subsequent to about the first seven days after start-up of the reactor the pour point of the product of said method is less than about 0° C. and the clear octane number of the gasoline fraction by-product of said method is higher than about 82.

13. The method of claim 1, 2 or 3 wherein the crystalline zeolite catalyst component contains hydrogen cations, ammonium cations or metal cations selected from Groups I through VIII of the Periodic Table.

14. The method of claim 13 wherein said metal cations are selected from Group VIII of the Periodic Table.

15. The method of claim 14 wherein said metal cations are nickel.

16. A catalytic hydrodewaxing process for a heavy oil fraction comprising the steps of contacting the heavy oil during startup with hydrogen in the presence of an acidic zeolite having a constraint index of about 1 to 12, at an average reactor temperature of about 200° C. to 310° C.; and uniformly increasing average reactor temperature at a daily increase of at least 10° C. to an average reactor temperature of at least about 360° C. with hydrogen circulation, wherein the average reactor temperature is increased to 360° C. within about the first seven days after startup of the reactor.

17. The process of claim 16 wherein the catalyst consists essentially of HZSM-5, said heavy oil fraction comprises petroleum distillate, wherein the pour point of hydrodewaxed distillate product at about seven days after startup is less than about 0° C. and the clear octane number of gasoline fraction by-product of said process is higher than about 82.

18. The process of claim 16 wherein the hydrodewaxing is conducted at a liquid hourly space velocity of about 0.2 to 10, a reactor pressure of about 100 to 3000 psig, and a hydrogen to hydrocarbon mole ratio from greater than 0 to about 20.

* * * * *